US007036888B2

(12) United States Patent
Yang et al.

(10) Patent No.: US 7,036,888 B2
(45) Date of Patent: May 2, 2006

(54) CHAIR WITH BIGHT FORMED IN LEG

(76) Inventors: Jian Hui Yang, Chidian, Jinjiang, Fujian (CN); Dennis M. Turner, 11350 N. Mann Rd., Mooresville, IN (US) 46158; Paul T. Zink, 915 N. Graham Ave., Indianapolis, IN (US) 46219; Jason Andrews, 4631 Aerie La., Indianapolis, IN (US) 46254

( * ) Notice: Subject to any disclaimer, the term of this patent is extended or adjusted under 35 U.S.C. 154(b) by 0 days.

(21) Appl. No.: 10/675,010

(22) Filed: Sep. 30, 2003

(65) Prior Publication Data

US 2004/0189059 A1 Sep. 30, 2004

Related U.S. Application Data

(63) Continuation-in-part of application No. 29/178,579, filed on Mar. 28, 2003, now Pat. No. Des. 481,549.

(51) Int. Cl.
*A47C 4/00* (2006.01)
*A47C 5/12* (2006.01)
*A47C 7/02* (2006.01)

(52) U.S. Cl. ..... 297/452.2; 297/451.13; 297/55

(58) Field of Classification Search ..... 297/58, 297/452.2, 451.13, 440.24, 452.18, 344.18, 297/55, 56, 16.1; 52/653.2, 731.2, 732.1; 428/34.1, 36.91, 192; 248/125.8, 406.1, 248/159

See application file for complete search history.

(56) References Cited

U.S. PATENT DOCUMENTS

D75,519 S 6/1928 Salomon
D75,556 S 6/1928 Glantz
2,007,898 A * 7/1935 Ragsdale ..... 52/692
D107,545 S 12/1937 O'Connor
2,401,542 A * 6/1946 Booth ..... 228/150
2,458,095 A 1/1949 O'Connor
2,509,107 A 5/1950 O'Connor
2,555,113 A * 5/1951 Burnham ..... 297/55
2,607,399 A 8/1952 O'Connor
2,861,625 A * 11/1958 Walton ..... 297/55
2,903,044 A * 9/1959 Peras ..... 297/446.2
2,991,123 A 7/1961 Hamilton
3,001,816 A 9/1961 Clarin
3,705,604 A * 12/1972 Christin ..... 138/178
4,105,244 A * 8/1978 Colby ..... 297/45
4,662,645 A * 5/1987 McMurtrey ..... 280/279
5,002,337 A * 3/1991 Engel et al. ..... 297/239
5,450,703 A * 9/1995 Fuhrman et al. ..... 52/730.4
5,634,684 A * 6/1997 Kojima et al. ..... 297/58
5,718,474 A * 2/1998 Kojima et al. ..... 297/58
5,934,201 A * 8/1999 Diffrient ..... 108/50.02
D436,457 S 1/2001 Ambasz
6,209,829 B1 * 4/2001 Yu ..... 248/122.1
6,234,571 B1 * 5/2001 Atkins et al. ..... 297/16.1
D446,661 S 8/2001 Ambasz
6,287,666 B1 * 9/2001 Wycech ..... 428/122
6,349,521 B1 * 2/2002 McKeon et al. ..... 52/735.1
D465,346 S 11/2002 Lin
D465,665 S 11/2002 Ritchie et al.
D465,940 S 11/2002 Nien
D467,759 S 12/2002 Dellinger (Continued)

*Primary Examiner*—Peter M. Cuomo
*Assistant Examiner*—Sarah B. McPartlin
(74) *Attorney, Agent, or Firm*—Barnes & Thornburg LLP

(57) ABSTRACT

A chair comprises a leg. The leg is formed to include a bight extending longitudinally along the leg to strengthen the leg.

12 Claims, 4 Drawing Sheets

U.S. PATENT DOCUMENTS

2002/0152715 A1* 10/2002 Rotheroe ..... 52/731.2
2003/0034676 A1* 2/2003 Wen et al. ..... 297/58
2003/0234563 A1* 12/2003 Huang ..... 297/58
2004/0032156 A1* 2/2004 Stipek ..... 297/452.18

* cited by examiner

CHAIR WITH BIGHT FORMED IN LEG

This application claims priority as a continuation-in-part under 35 U.S.C. §120 to U.S. application Ser. No. 29/178,579, filed Mar. 28, 2003, now U.S. Pat. No. D. 481,549 which is hereby incorporated by reference herein.

BACKGROUND

The present disclosure relates to chairs. More particularly, the present disclosure relates to legs of chairs.

SUMMARY

According to the present disclosure, a chair comprises a leg. The leg is formed to include a bight and a channel. The bight extends longitudinally along the leg to strengthen the leg. The channel includes a pair of spaced-apart end edges extending longitudinally along the leg. The bight interconnects the end edges and protrudes outwardly therefrom.

In some embodiments, the leg is tubular and relatively "flat" in that its width is larger than its depth. The leg includes a front side, a rear side, a laterally inner side, and a laterally outer side. The front and rear sides define the depth of the leg. The laterally inner and laterally outer sides define the width of the leg. The bight is formed in the front side when the leg is a front leg of the chair. The bight is formed in the rear side when the leg is a rear leg of the chair.

Additional features of the present disclosure will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
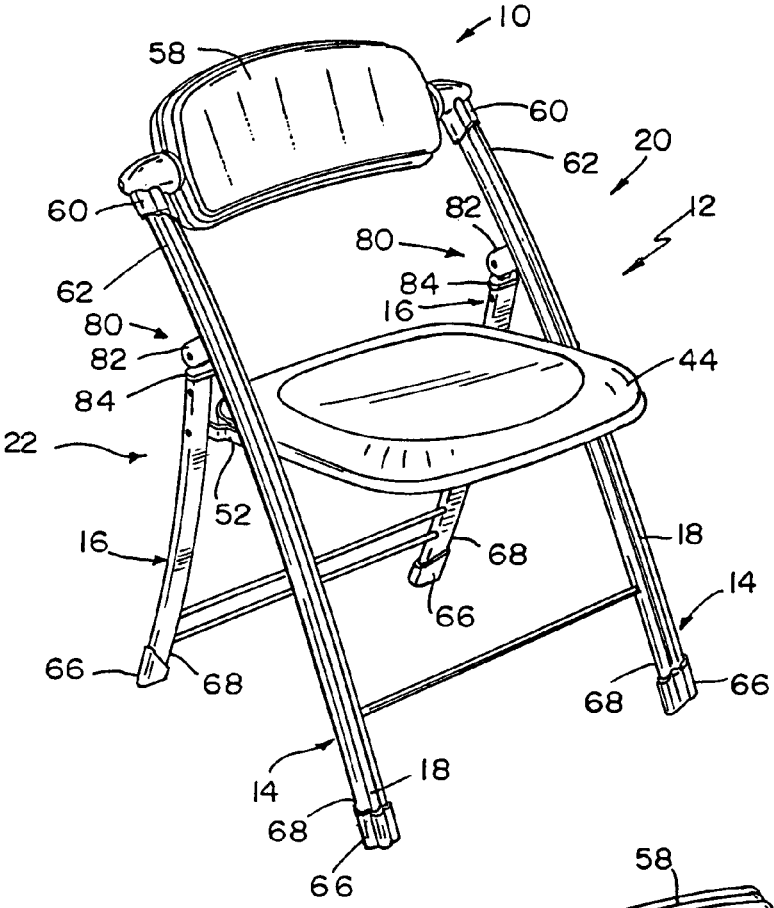
FIG. 1 is a perspective view showing a chair including a foldable frame that is positioned in an unfolded position and includes a pair of tubular front legs and a pair of tubular rear legs and showing each front leg including a bight extending longitudinally along a front side of the front leg for strength thereof.
Figure 2:
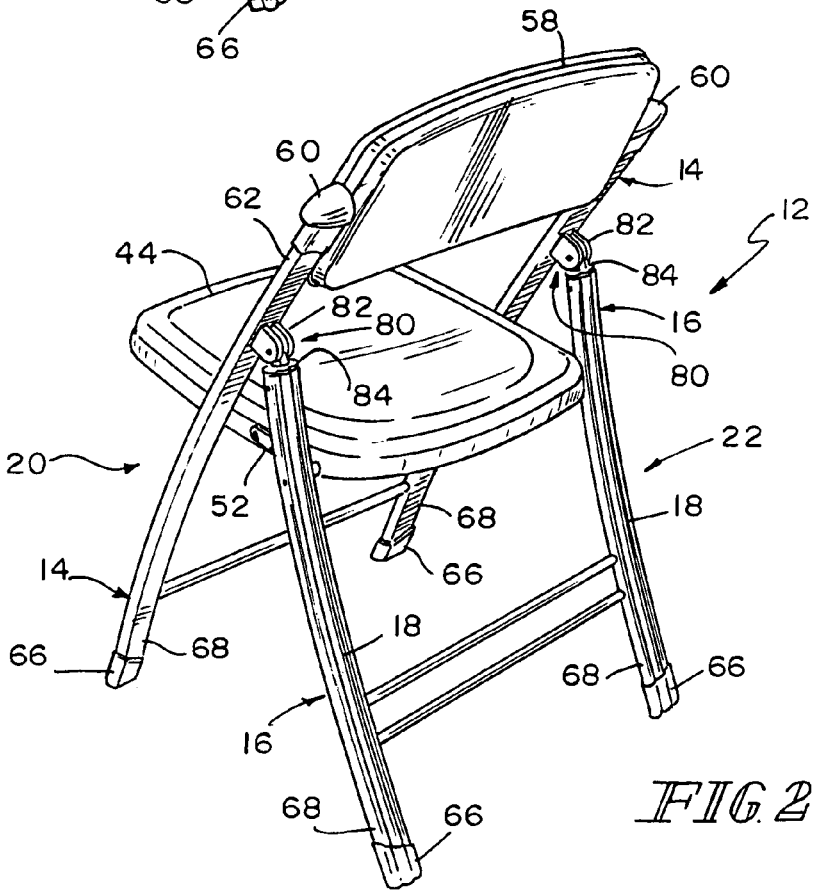
FIG. 2 is a rear perspective view of the chair of FIG. 1 showing each rear leg formed to include a bight extending longitudinally along a rear side of the rear leg for strength thereof.
Figure 3:
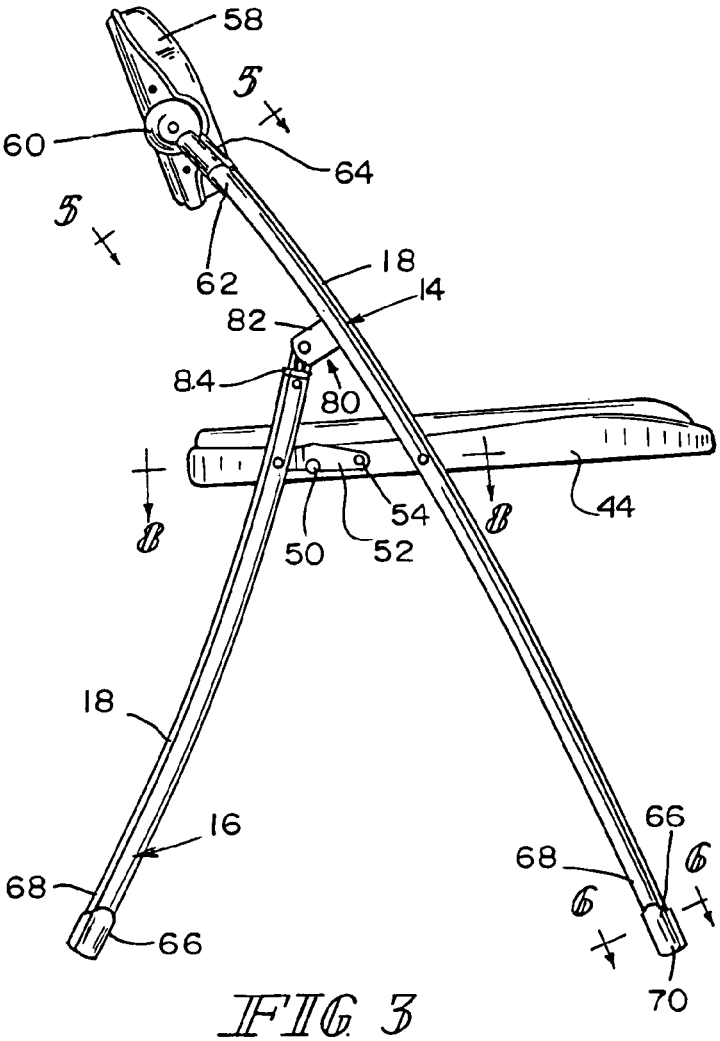
FIG. 3 is a side elevation view showing the chair in the unfolded position.

A chair 10 includes a pair of front legs 14 and a pair of rear legs 16, as shown, for example, in FIGS. 1 and 2. Each leg 14, 16 is formed to include a bight 18 extending longitudinally along leg 14, 16 to strengthen leg 14, 16. Bights 18 thus provide means for strengthening legs 14, 16 and thereby promote overall stability of chair 10.

Legs 14, 16 are included in a foldable frame 12 shown, for example, in FIGS. 1–4. Frame 12 includes front and rear leg units 20, 22 which are arranged for movement relative to one another between an unfolded position shown, for example, in FIGS. 1–3 and a folded position shown, for example, in FIG. 4. Front leg unit 20 includes front legs 14. Rear leg unit 22 includes rear legs 16.

Front legs 14 are similar to one another in structure and function so that the description of one front leg 14 applies to the other front leg 14 as well. Rear legs 16 are similar to one another in structure and function so that the description of one rear leg 16 applies to the other rear leg 16 as well.

Figure 5:
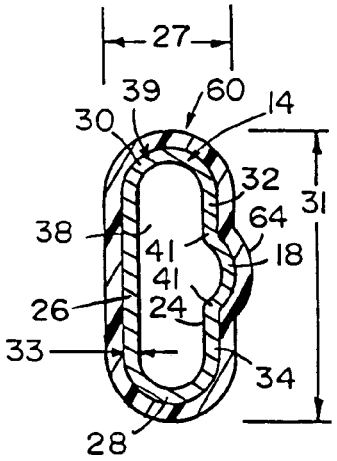
FIG. 5 is a sectional view taken along lines 5—5 of FIG. 3 and showing a chair back mount surrounding a top portion of one of the front legs and formed to include a bight mating with the bight formed in the front leg.
Figure 6:
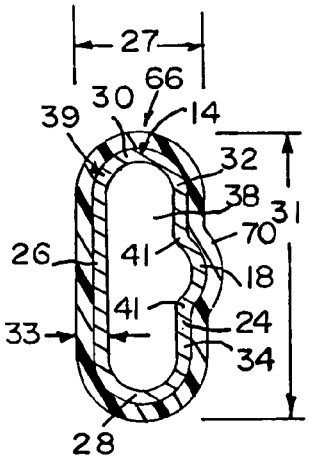
FIG. 6 is a sectional view taken along lines 6—6 of FIG. 3 and showing a foot surrounding a bottom portion of one of the front legs and formed to include a bight mating with the bight formed in the front leg.
Figure 4:
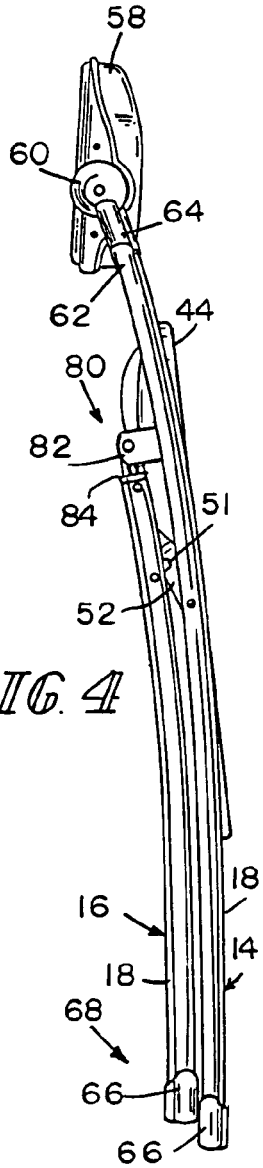
FIG. 4 is a side elevation view showing the chair in a folded position.
Figure 8:
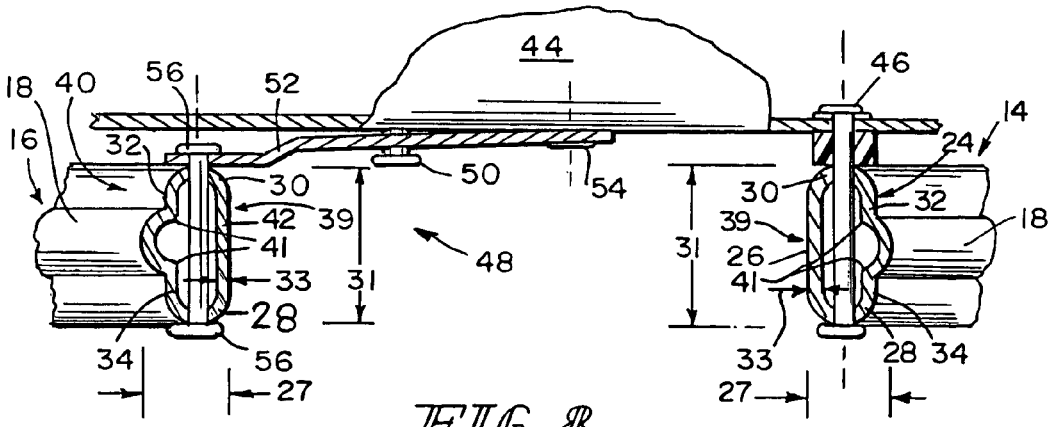
FIG. 8 is a sectional view, taken along lines 8—8 of FIG. 3, showing components of a rear leg pivoter coupled to a seat and one of the rear legs to pivot the rear leg relative to one of the front legs upon pivotable movement of the seat.

In the illustrated embodiment, front leg 14 is tubular and relatively "flat" in that it is wider than it is deep, as suggested in FIGS. 5, 6, and 8. Front and rear sides 24, 26 of leg 14 define a depth 27 (e.g., about ⅝ inch or 1.59 cm) of leg 14. Laterally outer and laterally inner sides 28, 30 of leg 14 define a width 31 (e.g., about 1.5 inches or 3.81 cm) of leg 14. Width 27 of leg 14 is greater than depth 31 of leg 14. Leg 14 is relatively thin-walled and has a thickness 33 (e.g., about 1/16 inch or 0.16 cm). The material of leg 14 is, for example, metal such as steel.

Front side 24 of leg 14 is formed to include bight 18 extending longitudinally along leg 14, as shown, for example, in FIGS. 1, 5, 6, and 8. Front side 24 is further formed to include a laterally inner portion 32 and a laterally outer portion 34, as shown, for example, in FIGS. 5, 6, and 8. Inner and outer portions 32, 34 of leg 14 are co-planar in cross-section. Bight 18 of leg 14 is positioned therebetween. Inner portion 32 is generally straight in cross-section and extends from inner side 30 to bight 18. Outer portion 34 is generally straight in cross-section and extends from bight 18 to outer side 28. Bight 18 protrudes forwardly in relation to laterally inner portion 32 and laterally outer portion 34 and has a U-shaped cross-section. Bight 18 and leg 14 formed to include bight 18 are bowed along their lengths.

Rear side 26 of leg 14 is generally straight in cross-section and extends from laterally inner side 30 to laterally outer side 28 as shown, for example, in FIGS. 5, 6, and 8. Rear side 26 is arranged to lie in spaced-apart relation to inner portion 32, bight 18, and outer portion 34, and laterally outer and inner sides 28, 30 to define an interior region 38.

Laterally inner and laterally outer sides 28, 30 of leg 14 extend between front and rear sides 24, 26 of leg 14, as shown, for example, in FIGS. 5, 6, and 8. Laterally inner and laterally outer sides 28, 30 are curved in cross-section. In the illustrated embodiment, they are semi-circular in cross-section.

Rear side 26, laterally inner and laterally outer sides 28, 30, and laterally inner and laterally outer portions 32, 34 of front side 24 cooperate to provide a channel 39 of leg 14, as shown, for example, in FIGS. 5–8. Each portion 32, 34 provides an end edge 41 of channel 39 extending longitudinally along leg 14. Edges 41 are spaced apart from one another to define a gap therebetween. Bight 18 of leg 14 interconnects edges 41 and protrudes outwardly therefrom. In the illustrated embodiment, channel 39 of leg 14 is oblong and C-shaped.

In some embodiments, channel 39 of leg 14 includes a pair of U-shaped channel members (not shown). The U-shaped channel members are coupled to bight 18 on either side thereof. First ends of the U-shaped channel members provide the edges 41 and are coupled to bight 18. Second ends of the U-shaped channel members are spaced apart from one another to define a gap therebetween.

In the illustrated embodiment, rear leg 16 is tubular and relatively "flat" in that it is wider than it is deep, as suggested in FIG. 8. Front and rear sides 42, 40 of leg 16 define a depth 27 (e.g., about ⅝ inch or 1.59 cm) of leg 16. Laterally outer and laterally inner sides 28, 30 of leg 16 define a width 31 (e.g., about 1.5 inches or 3.81 cm) of leg 16. Width 27 of leg 16 is greater than depth 31 of leg 16. Leg 16 is relatively thin-walled and has a thickness 33 (e.g., about 1/16 inch or 0.16 cm). The material of leg 16 is, for example, metal such as steel.

Rear side 40 of leg 16 is formed to include bight 18 extending longitudinally along leg 16, as shown, for example, in FIGS. 2 and 8. Rear side 40 is further formed to include a laterally inner portion 32 and a laterally outer portion 34, as suggested in FIGS. 7 and 8. Inner and outer portions 32, 34 of leg 16 are co-planar in cross-section. Bight 18 of leg 16 is positioned therebetween. Inner portion 32 is generally straight in cross-section and extends from inner side 30 to bight 18. Outer portion 34 is generally straight in cross-section and extends from bight 18 to outer side 28. Bight 18 protrudes rearwardly in relation to laterally inner portion 32 and laterally outer portion 34 and is U-shaped in cross-section. Bight 18 and leg 16 formed to include bight 18 are bowed along their lengths.

Figure 7:
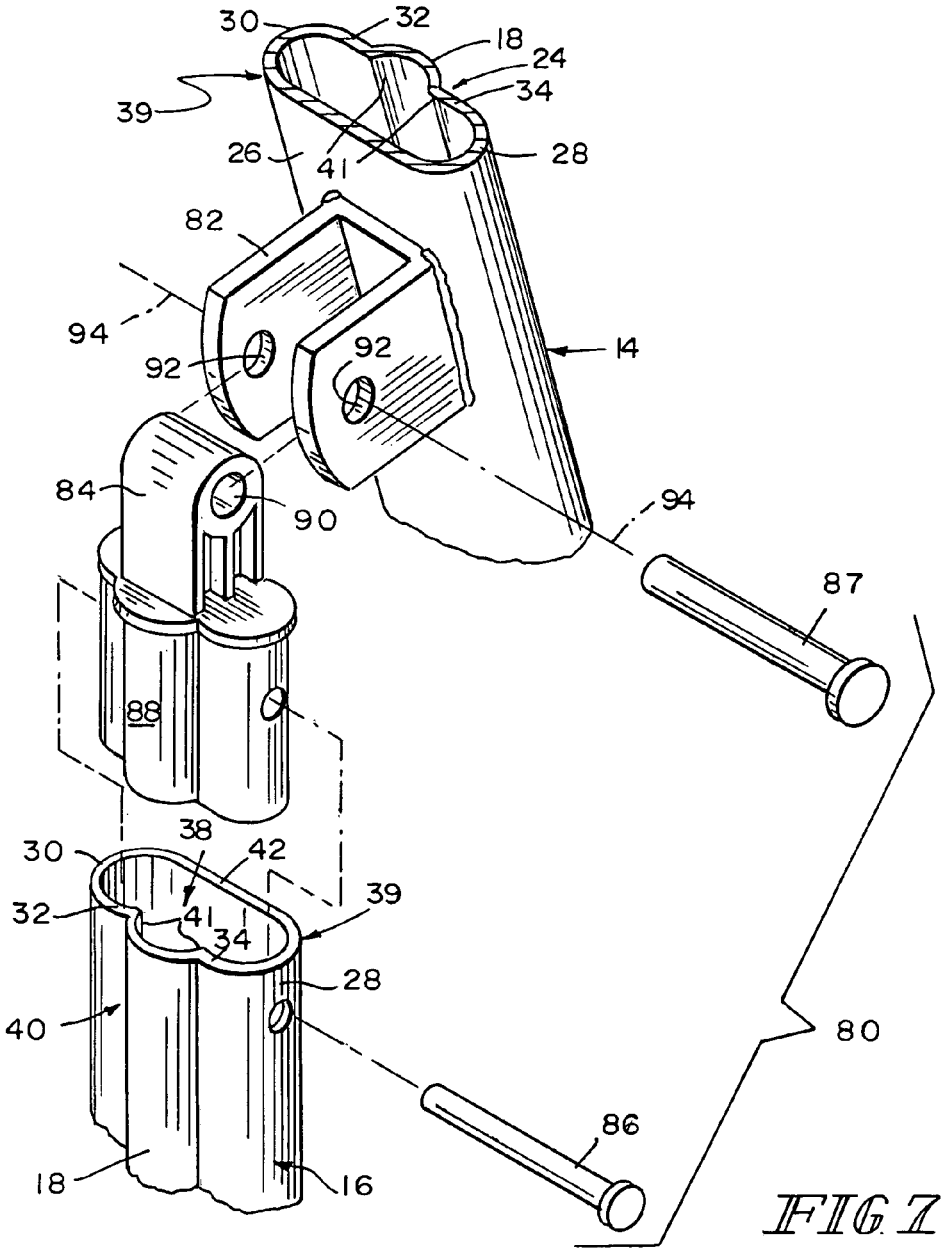
FIG. 7 is an exploded perspective view, with portions broken away, showing components of a leg pivot mount to support one of the rear legs for pivotable movement relative to one of the front legs.

Front side 42 of leg 16 is generally straight in cross-section and extends from laterally inner side 30 to laterally outer side 28 as shown, for example, in FIGS. 7 and 8. Front side 42 is arranged to lie in spaced-apart relation to inner portion 32, bight 18, and outer portion 34, and laterally outer and inner sides 28, 30 to define an interior region 38.

Front side 42, laterally inner and laterally outer sides 28, 30, and laterally inner and laterally outer portions 32, 34 of rear side 40 cooperate to provide a channel 39 of leg 16, as shown, for example, in FIGS. 7 and 8. Each portion 32, 34 provides an end edge 41 of channel 39 extending longitudinally along leg 16. Edges 41 are spaced apart from one another to define a gap therebetween. Bight 18 of leg 16 interconnects edges 41 and protrudes outwardly therefrom. In the illustrated embodiment, channel 39 of leg 16 is oblong and C-shaped.

In some embodiments, channel 39 of leg 16 includes a pair of U-shaped channel members (not shown). The U-shaped channel members are coupled to bight 18 on either side thereof. First ends of the U-shaped channel members provide the edges 41 and are coupled to bight 18. Second ends of the U-shaped channel members are spaced apart from one another to define a gap therebetween.

Chair 10 includes a pair of leg pivot mounts 80 to mount rear leg unit 22 for pivotable movement relative to front leg unit 20 between the unfolded and folded positions, as shown, for example, in FIGS. 1–4 and 7. Each leg pivot mount 80 includes a bracket 82 coupled to rear side 26 of a front leg 14, a pivot cap 84 coupled to a top end of a rear leg 16 by a fastener 86, and a leg pivot axle 87 coupling bracket 82 and pivot cap 84 to one another for pivotable movement of rear leg 16 relative to front leg 14. Pivot cap 84 extends into interior region 38 of rear leg 16 and is formed to include a bight 88 mating with a bight 18 formed in rear leg 16. Fastener 86 extends through laterally outer side 28 and inner side 30 and between bight 18 formed in rear side 40 of leg 16 and front side 42 of leg 16. Leg pivot axle 87 extends through an aperture 90 formed in pivot cap 84 and a pair of apertures 92 formed in bracket 82 to establish a leg pivot axis 94 about which rear leg 16 can pivot.

Chair 10 includes a rear leg pivoter 48 shown in FIG. 8 and configured to pivot rear leg 16 relative to front leg 14 upon pivotable movement of a seat 44 included in chair 10. Leg pivoter 48 includes a link 52, a first link pivot axle 54 coupled to link 52 and seat 44, a second link pivot axle 56 coupled to link 52 and rear leg 16, and a pivot stop 50 coupled to seat 44. Second link pivot axle 56 extends through laterally inner side 30 and laterally outer side 28 of leg 16 between bight 18 formed on rear side 40 of leg 16 and front side 42 of leg 16. Pivot stop 50 cooperates with a downwardly facing retention groove 51 shown in FIG. 4 and formed in link 52 to stop pivotable movement of seat 44 when frame 12 assumes the unfolded position.

A seat pivot axle 46 shown in FIG. 8 is coupled to seat 44 and a front leg 14 for pivotable movement of seat 44 relative to front leg 14. Seat axle 46 extends through laterally inner side 30 and laterally outer side 28 of front leg 14 and between bight 18 formed in front side 24 of leg 14 and rear side 26 of leg 14.

Chair 10 further includes a chair back 58 and a pair of chair back mounts 60, as shown, for example, in FIGS. 1 and 2. Chair back mounts 60 are coupled to chair back 58 to support chair back 58 for pivotable movement. Each chair back mount 60 is coupled to a top portion 62 of a front leg 14 and is formed to include a bight 64 mating with bight 18 formed in front leg 14, as shown, for example, in FIG. 5.

Chair 10 further includes a foot 66 coupled to a bottom portion 68 of each leg 14, 16. Foot 66 is formed to include a bight 70 mating with bight 18 formed in each leg 14, 16.

Figure 9:
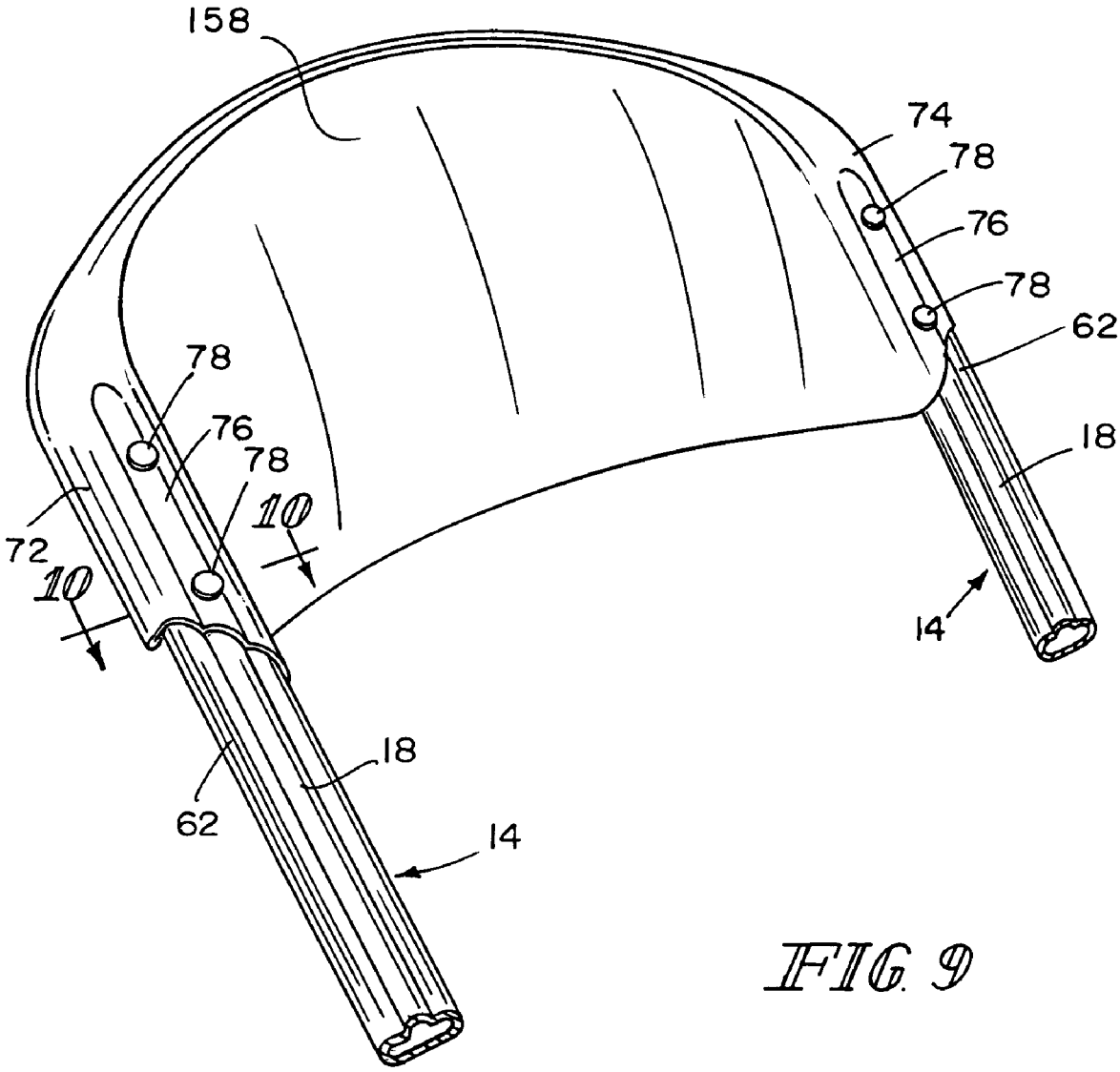
FIG. 9 is a perspective view, with portions broken away, showing another chair back coupled to top portions of the front legs.
Figure 10:
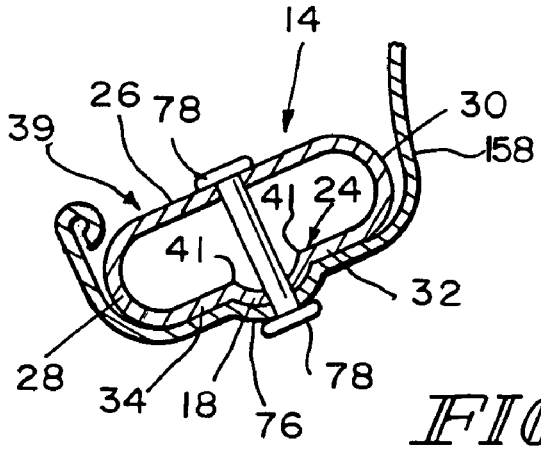
FIG. 10 is a sectional view taken along lines 10—10 of FIG. 9 and showing a bight formed in the chair back mating with the bight formed in one of the front legs.

In some embodiments, chair 10 may include a chair back 158, as shown, for example, in FIG. 9. Chair back 158 is coupled to first and second chair back mounts 72, 74. Chair back mounts 72, 74 are coupled to top portions 62 of front legs 14 by fasteners 78. Each chair back mount 72, 74 is formed to include a bight 76 mating with the bight 18 formed in front leg 14 as shown, for example, in FIG. 10. Each fastener 78 extends through bights 76 and 18 and rear side 26.

What is claimed is:

1. A chair comprising a tubular front leg and a tubular rear leg coupled to the front leg, each leg including a front side, a rear side, a laterally outer side, and a laterally inner side, the front and rear sides of each leg defining a depth of the leg, the laterally outer and laterally inner sides of each leg defining a width of the leg which is larger than the depth of the leg, the front side of the front leg being formed to include means for strengthening the front leg, the rear side of the rear leg being formed to include means for strengthening the rear leg, the front leg strengthening means including only one bight extending longitudinally along the front leg and projecting outwardly from the front side of the front leg in a forward-facing direction, the rear leg strengthening means including only one bight extending longitudinally along the rear leg and projecting outwardly from the rear side of the rear leg in a rearward-facing direction opposite to the forward facing direction.

2. A chair comprising a tubular front leg and a tubular rear leg coupled to the front leg, each leg including a front side, a rear side, a laterally outer side, and a laterally inner side, the front and rear sides of each leg defining a depth of the leg, the laterally outer and laterally inner sides of each leg defining a width of the leg which is larger than the depth of the leg, the front side of the front leg being formed to include means for strengthening the front leg, the rear side of the rear leg being formed to include means for strengthening the rear leg, the front leg strengthening means including a bight extending longitudinally along the front leg, the rear leg strengthening means including a bight extending longitudinally along the rear leg, wherein, with respect to the front leg, each of the laterally inner and laterally outer sides is semi-circular in cross-section, the rear side is straight in cross-section and extends from the laterally inner side to the laterally outer side, and the front side includes laterally inner and laterally outer portions that are co-planar in cross-section, the laterally inner portion is straight in cross-section and extends from the laterally inner side to the bight, the laterally outer portion is straight in cross-section and extends from the laterally outer side to the bight, and the bight protrudes forwardly from the laterally inner and laterally outer portions.

3. A chair comprising a tubular front leg and a tubular rear leg coupled to the front leg, each leg including a front side, a rear side, a laterally outer side, and a laterally inner side, the front and rear sides of each leg defining a depth of the leg, the laterally outer and laterally inner sides of each leg defining a width of the leg which is larger than the depth of the leg, the front side of the front leg being formed to include means for strengthening the front leg, the rear side of the rear leg being formed to include means for strengthening the rear leg, the front leg strengthening means including a bight extending longitudinally along the front leg, the rear leg strengthening means including a bight extending longitudinally along the rear leg, wherein, with respect to the rear leg, each of the laterally inner and laterally outer sides is semi-circular in cross-section, the front side is straight in cross-section and extends from the laterally inner side to the laterally outer side, and the rear side includes laterally inner and laterally outer portions that are co-planar in cross-section, the laterally inner portion is straight in cross-section and extends from the laterally inner side to the bight, the laterally outer portion is straight in cross-section and extends from the laterally outer side to the bight, and the bight protrudes rearwardly from the laterally inner and laterally outer portions.

4. The chair of claim 1, further comprising a leg pivot mount coupled to the rear leg and a rear side of the front leg for pivotable movement of the rear leg relative to the front leg.

5. A chair comprising a tubular front leg and a tubular rear leg coupled to the front leg, each leg including a front side, a rear side, a laterally outer side, and a laterally inner side, the front and rear sides of each leg defining a depth of the leg, the laterally outer and laterally inner sides of each leg defining a width of the leg which is larger than the depth of the leg, the front side of the front leg being formed to include means for strengthening the front leg, the rear side of the rear leg being formed to include means for strengthening the rear leg, the front leg strengthening means including a bight extending longitudinally along the front leg, the rear leg strengthening means including a bight extending longitudinally along the rear leg, a seat, a seat pivot axle coupled to the seat and the front leg for pivotable movement of the seat relative to the front leg, and a rear leg pivoter coupled to the seat and the rear leg to pivot the rear leg relative to the front leg upon pivotable movement of the seat, wherein the seat axle extends through the laterally inner and laterally outer sides of the front leg and between the bight formed in the front leg and an opposite side of the front leg, the rear leg pivoter includes a link, a first link pivot axle coupled to the link and the seat, and a second link pivot axle coupled to the link and the rear leg, and the second link pivot axle extends through the laterally inner and laterally outer sides of the rear leg and between the bight formed in the rear leg and an opposite side of the rear leg.

6. A chair comprising a seat, a tubular leg coupled to the seat, the tubular leg including a front side, a rear side, a laterally outer side, and a laterally inner side, the front and rear sides defining a depth of the leg, the laterally outer and laterally inner sides defining a width of the leg, the width being larger than the depth, one of the front side and the rear side being formed to include a bight extending longitudinally along the leg to strengthen the leg, wherein each of the laterally inner and laterally outer sides is semi-circular in cross-section, the rear side is straight in cross-section and extends from the laterally inner side to the laterally outer side, and the front side extends from the laterally inner side to the laterally outer side and is formed to include the bight and wherein the front side includes laterally inner and laterally outer portions that are co-planar in cross-section, the laterally inner portion is straight in cross-section and extends from the laterally inner side to the bight, the laterally outer portion is straight in cross-section and extends from the laterally outer side to the bight, and the bight protrudes forwardly from the laterally inner and laterally outer portions.

7. A chair comprising a seat, a tubular leg coupled to the seat, the tubular leg including a front side, a rear side, a laterally outer side, and a laterally inner side, the front and rear sides defining a depth of the leg, the laterally outer and laterally inner sides defining a width of the leg, the width being larger than the depth, one of the front side and the rear side being formed to include a bight extending longitudinally along the leg to strengthen the leg, wherein each of the laterally inner and laterally outer sides is semi-circular in cross-section, the front side is straight in cross-section and extends from the laterally inner side to the laterally outer side, and the rear side extends from the laterally inner side to the laterally outer side and includes the bight, and wherein the rear side includes laterally inner and laterally outer portions that are co-planar in cross-section, the laterally inner portion is straight in cross-section and extends from the laterally inner side to the bight, the laterally outer portion is straight in cross-section and extends from the laterally outer side to the bight, and the bight protrudes rearwardly from the laterally inner and laterally outer portions.

8. A chair comprising a foldable frame including a front leg unit and a rear leg unit, the front and rear leg units being arranged to move relative to one another between folded and unfolded positions, each leg unit comprising a pair of tubular legs, each leg including a front side, a rear side, a laterally outer side extending between the front and rear sides, and a laterally inner side extending between the front and rear sides, the front side of each leg of the front leg unit being formed to include inner and outer coplaner portions with a bight extending between the coplaner portions and extending longitudinally along the leg for strength thereof, the rear side of each front leg being formed without a bight, the rear side of each leg of the rear leg unit being formed to include a bight extending longitudinally along the leg for strength thereof, the rear side of each rear leg being formed without a bight.

9. A chair comprising a foldable frame including a front leg unit and a rear leg unit, the front and rear leg units being arranged to move relative to one another between folded and unfolded positions, each leg unit comprising a pair of tubular legs, each leg including a front side, a rear side, a laterally outer side extending between the front and rear sides, and a laterally inner side extending between the front and rear sides, the front side of each leg of the front leg unit being formed to include a bight extending longitudinally along the leg for strength thereof, the rear side of each leg of the rear leg unit being formed to include a bight extending longitudinally along the leg for strength thereof, wherein, with respect to each front leg, each of the laterally inner and laterally outer sides is semi-circular in cross-section, the rear side is straight in cross-section and extends from the laterally inner side to the laterally outer side, the front side includes laterally inner and laterally outer portions that co-planar in cross-section, the laterally inner portion is straight in cross-section and extends from the laterally inner side to the bight, the laterally outer portion is straight in cross-section and extends from the laterally outer side to the bight, and the bight protrudes forwardly from the laterally inner and laterally outer portions.

10. A chair comprising a foldable frame including a front leg unit and a rear leg unit, the front and rear leg units being arranged to move relative to one another between folded and unfolded positions, each leg unit comprising a pair of tubular legs, each leg including a front side, a rear side, a laterally outer side extending between the front and rear sides, and a laterally inner side extending between the front and rear sides, the front side of each leg of the front leg unit being formed to include a bight extending longitudinally along the leg for strength thereof, the rear side of each leg of the rear leg unit being formed to include a bight extending longitudinally along the leg for strength thereof, wherein, with respect to each rear leg, each of the laterally inner and laterally outer sides is semi-circular in cross-section, the front side is generally straight in cross-section and extends from the laterally inner side to the laterally outer side, the rear side includes laterally inner and laterally outer portions that are co-planar in cross-section, the laterally inner portion is generally straight in cross-section and extends from the laterally inner side to the bight, the laterally outer portion is straight in cross-section and extends from the laterally outer side to the bight, and the bight protrudes rearwardly from the laterally inner and laterally outer portions.

11. A chair comprising a foldable frame including a front leg unit and a rear leg unit, the front and rear leg units being arranged to move relative to one another between folded and unfolded positions, each leg unit comprising a pair of tubular legs, each leg including a front side, a rear side, a laterally outer side extending between the front and rear sides, and a laterally inner side extending between the front and rear sides, the front side of each leg of the front leg unit being formed to include a bight extending longitudinally along the leg for strength thereof, the rear side of each front leg being formed without a bight, the rear side of each leg of the rear leg unit being formed to include a bight extending longitudinally along the leg for strength thereof, the rear side of each rear leg being formed without a bight, and further comprising a chair back and a chair back mount coupled to the chair back and each front leg, wherein each chair back mount is formed to include a bight mating with the bight formed in the front leg to which the chair back mount is coupled.

12. A chair comprising a foldable frame including a front leg unit and a rear leg unit, the front and rear leg units being arranged to move relative to one another between folded and unfolded positions, each leg unit comprising a pair of tubular legs, each leg including a front side, a rear side, a laterally outer side extending between the front and rear sides, and a laterally inner side extending between the front and rear sides, the front side of each leg of the front leg unit being formed to include a bight extending longitudinally along the leg for strength thereof, the rear side of each front leg being formed without a bight, the rear side of each leg of the rear leg unit being formed to include a bight extending longitudinally along the leg for strength thereof, the rear side of each rear leg being formed without a bight, and further comprising a foot coupled to a bottom portion of each leg, wherein each foot is formed to include a bight mating with the bight formed in the leg to which the foot is coupled.

* * * * *